US005326233A

United States Patent [19]

Mochizuki et al.

[11] Patent Number: 5,326,233

[45] Date of Patent: Jul. 5, 1994

[54] ENCLOSED MOTOR COMPRESSOR OF A TWO CYLINDER TYPE

[75] Inventors: Tetsuya Mochizuki; Susumu Kawaguchi; Masatoshi Sakai; Koichi Sato; Hideaki Maeyama, all of Shizuoka, Japan

[73] Assignee: Mitsubishi Denki Kabushiki Kaisha, Tokyo, Japan

[21] Appl. No.: 9,229

[22] Filed: Jan. 26, 1993

[30] Foreign Application Priority Data

Jul. 3, 1992 [JP] Japan ..... 4-177008

[51] Int. Cl.[5] ..... F04B 27/08

[52] U.S. Cl. ..... 417/350; 417/359

[58] Field of Search ..... 417/350, 359, 360

[56] References Cited

U.S. PATENT DOCUMENTS

| | | | |
|---|---|---|---|
| 2,643,614 | 6/1953 | Rosenkrans | 417/350 X |
| 3,195,468 | 7/1965 | Bood | 417/350 |
| 4,645,430 | 2/1987 | Carelton | 417/359 |
| 4,889,475 | 12/1989 | Gannaway | 417/350 |
| 4,971,529 | 11/1990 | Gannaway et al. . | |

FOREIGN PATENT DOCUMENTS 48-105105 11/1973 Japan .

59-21095 2/1984 Japan .

*Primary Examiner*—Richard E. Gluck

*Attorney, Agent, or Firm*—Oblon, Spivak, McClelland, Maier & Neustadt

[57] ABSTRACT

An enclosed motor compressor of a two cylinder type in which a clearance between the eccentric portion of the second rotary shaft and the second sub bearing is set greater than a clearance between the eccentric portion of the first rotary shaft and the first main bearing, and also there is formed a clearance between the eccentric portion of the second rotary shaft and the second main bearing, so that, even when the second rotary shaft moves in the axial direction thereof, there is eliminated the possibility that the eccentric portion of the second rotary shaft can be in touch with the second main bearing and second sub bearing in the axial direction, thereby being able to reduce noise. Also, the pair of main bearings further include, on the side of the compression elements, assembling jig mounting portions to which the assembling jig can be mounted. Due to this, when assembling the main bearings, the accuracy with which the main bearings are made parallel to each other can be improved, and thus the performance and reliability of the compressor can be improved, thereby being able to reduce noise.

4 Claims, 8 Drawing Sheets

ENCLOSED MOTOR COMPRESSOR OF A TWO CYLINDER TYPE

BACKGROUND OF THE INVENTION

1. Field of the Invention

The present invention relates to the reduction of noise of a rotary part of an enclosed compressor of a two cylinder type as well as the improved accuracy in assembling the same compressor.

2. Description of the Prior Art

FIGS. 9A and 9B respectively show section views of a conventional compressor of a two cylinder type, which is disclosed in, for example, Japanese Utility Model Publication (Kokai) Sho-48-10515. In FIGS. 9A and 9B, reference character 1 designates a closed vessel; 2, a motor element; 3, a stator mounted to the closed vessel 1 in a shrinkage fit manner; 4, a rotor which cooperates with the stator 3 in forming the motor element 2; 4*a*, an axial hole formed in the rotor 4; 5, a first rotary shaft which is press fixed to the rotor 4; 6, a first compression element to be driven by the first rotary shaft 5; 7, a second rotary shaft; 7*a*, an eccentric portion of the second rotary shaft 7; 8, a key which is used to restrict the sliding of the second rotary shaft 7 and rotor 4; 9, a key storage groove formed in the rotor 4; 10, an air gap formed between the rotor 4 and stator 3; and 11, a fastening clearance which is set smaller than the air gap 10 and is formed between the second rotary shaft 7 and rotor 4. Also, 12 stands for a second compression element which is composed of a cylinder 13, a rolling piston 14 and the above-mentioned rotary shaft 7. Further, 15 designates a first main bearing which is used to support the first rotary shaft 5; 16, a second main bearing used to support the second rotary shaft 7; 18, a second sub bearing for supporting the second rotary shaft 7; and 19, an opening which is formed by the end portion of the second rotary shaft 7 and a second sub bearing 18 and is closed by an end plate 20. In addition, the first compression element 6 is similar in structure to the second compression element 12, 26 designates a suction pipe, and 27 stands for a discharge pipe which discharges compressed gas.

Next, description will be given below of the operation of the above-mentioned conventional compressor. If the stator 3 and rotor 4 cooperating together to form the motor element are electrically energized, then the rotor 4 is allowed to start rotating, which drives the first rotary shaft 5 to rotate and also drives through the key 8 the second rotary shaft 7 to rotate. In the second compression element 12, the rolling piston 14 mounted to the eccentric portion 7*a* of the second rotary shaft 7 is caused to rotate eccentrically to thereby compress gas sucked in through the inlet pipe 26, and the compressed gas is then discharged through the discharge pipe 27 mounted to the closed vessel 1. Also, in the first compression element 6, a similar operation is executed.

However, since the conventional two cylinder type compressor is constructed in the above-mentioned manner, the movement of the second rotary shaft in the axial direction thereof is made unstable, with the result that noise is easy to occur due to the unstable axial movement of the second rotary shaft. Also, due to the fact that the second rotary shaft 7 is fastened to the rotor 4 by the key 8, noise is easy to occur due to a backlash between them. Further, because the inner periphery of the rotor 4 is repeatedly contacted with and removed from the second rotary shaft 5, there is generated noise.

Also, due to the fact that the first and second rotary shafts 5 and 7 are constructed in an integral structure by the rotor 4, especially, in assembling the compressor, there is required a high assembling accuracy in paralleling and aligning axially the first and second main bearings 15 and 16 with each other and, if such high accuracy cannot be secured, then the performance and reliability of the compressor are lowered and noise is increased, which are problems to be solved.

SUMMARY OF THE INVENTION

The present invention aims at eliminating the drawbacks found in the above-mentioned conventional two cylinder type compressor. Accordingly, it is an object of the invention to provide a two cylinder type compressor which can prevent occurrence of noise due to the axial movement of the rotary shaft, occurrence of noise due to a backlash produced in the portions of the rotor and rotary shaft which are fastened by the key, and occurrence of noise due to the repeated contact and removal between the inner periphery of the rotor and the rotary shaft.

Also, it is another object of the invention to provide a new two cylinder type compressor which can improve, when assembling the compressor, the paralleling and axially aligning accuracy with respect to a pair of main bearings to thereby enhance the performance and reliability of the compressor and reduce noise and also to provide a manufacturing method which is ideal for such improved compressor.

In attaining the above objects, according to the first aspect of the invention, there is provided an enclosed motor compressor of a two cylinder type, which comprises: a pair of rotary shafts respectively including eccentric portions which are used to drive a pair of compression elements respectively disposed at both ends of a motor element; a pair of first and second sub bearings respectively disposed on the opposite sides of the pair of compression elements to the motor element for supporting the pair of rotary shafts, and a pair of first and second main bearings respectively interposed between the motor element and the pair of compression elements for supporting said pair of rotary shafts; a clearance A formed between a surface of the first sub bearing forming one of the pair of sub bearings and an end face of the eccentric portion of the first rotary shaft forming one of the pair of rotary shafts, the surface of the first sub bearing being perpendicular to the slide surface thereof and facing the first compression element forming one of the compression elements and provided on the first sub bearing, the end face being opposed to the first sub bearing surface, the clearance A being arranged such that, when the first rotary shaft moves in the direction of the first compression element, then the clearance A can be made to disappear, that is, the surface of the first sub bearing and the end face of the eccentric portion of the first rotary shaft are brought into contact with each other; a clearance B formed between a surface of the first main bearing and an end face of the eccentric portion of the first rotary shaft, the surface of the first main bearing being perpendicular to the slide surface thereof and facing the first compression element, the end face being opposed to the first main bearing surface, the clearance B being generated when the clearance A is caused to disappear, that is, the surface of the first sub bearing and the end face of the eccentric portion of the first rotary shaft are brought into contact with each other; a clearance C formed between a surface of the second sub bearing forming the other of the pair of sub bearings and an end face of the eccentric portion of the second rotary shaft forming the other of the pair of rotary shafts, the surface of the second sub bearing being perpendicular to the slide surface thereof and facing the second compression element forming the other of the pair of compression elements and provided on the second sub bearing, the end face being opposed to the second sub bearing surface, the clearance C being generated when the clearance A is caused to disappear, that is, the surface of the first sub bearing and the end face of the eccentric portion of the first rotary shaft are brought into contact with each other, the clearance C being set greater than the clearance B; and a clearance D formed between a surface of the second main bearing perpendicular to the slide surface thereof and facing the second compression element provided on the second main bearing and an end face of the eccentric portion of the second rotary shaft opposed to the second main bearing surface, the clearance D being generated when the clearance A is caused to disappear, that is, the surface of the first sub bearing and the end face of the eccentric portion of the first rotary shaft are brought into contact with each other.

Also, to achieve the above objects, according to the second aspect of the invention, there is provided an enclosed motor compressor of a two cylinder type, which comprises: a closed vessel; a motor element which is provided within the closed vessel; a pair of compression elements respectively consisting of a cylinder disposed at both ends of the motor element and a rolling piston disposed within the cylinder; a pair of main bearings respectively interposed between the pair of compression elements and the motor element, the pair of compression elements supporting two rotary shafts respectively for mounting the compression elements thereto and being driven by the motor element; a pair of compression element side finish surfaces of the main bearings perpendicular to the slide surfaces of the main bearings, extending beyond the outside diameter of the cylinder, and worked so as to be touchable by an assembling jig for assembling the main bearings in parallel to the closed vessel; and assembling jig mounting portions respectively provided on the compression sides of the main bearings extending in the same direction of the pair of compression element side finish surfaces for mounting the assembling jig.

Further, the enclosed motor compressor of a two cylinder type of the invention further includes first and second compression elements respectively disposed on both sides of the motor element, a first rotary shaft which is used to drive the first compression element connected to one of the rotors of the motor element in a close fit manner, and a second rotary shaft which is used to drive the second compression element connected to the other of the rotors of the motor element in a close fit manner or in an adhesive manner.

Still further, the assembling jig employed in the above-mentioned enclosed motor compressor of a two cylinder type of the invention comprises: a first cylinder having an opening at one end thereof; a second cylinder which is disposed coaxially with the first cylinder at the other end of the first cylinder and has an outside diameter larger than that of the first cylinder; a side plate of the second cylinder which is disposed on the opposite side to the first cylinder; a first cylinder end face of the first cylinder disposed on the opening side thereof so as to be touchable with the compression element side finish surfaces of the main bearings, a second cylinder end face disposed in parallel to the first cylinder end face on the side of the first cylinder so as to be touchable with an end face of a center shell serving as the outer shell of the closed vessel containing therein the motor element, the second cylinder end face being used to make the pair of main bearings be parallel to each other, and a boss projecting out from the side plate into the second cylinder, the boss being disposed on the opposite side of the compression elements to the motor element so as to be touchable with a cylinder having a finish surface on the inner or outer periphery thereof projecting on the opposite side of the motor element into a pair of sub bearings supporting the rotary shafts, the boss being coaxial with the outer periphery of the second cylinder to thereby be able to align the pair of sub bearings axially with each other.

Yet further, to accomplish the above objects, according to the invention, there is provided a method of assembling an enclosed motor compressor of a two cylinder type, which comprises the steps of: assembling a first sub bearing for supporting a first rotary shaft, a first compression element comprising a cylinder and a rolling piston, and a first main bearing for supporting the first rotary shaft to one end of the first rotary shaft to be driven by a rotor of a motor element and, after then, connecting one portion of the rotor to the other end of the first rotary shaft in a close fit manner to thereby form a first integral structure; assembling a second sub bearing for supporting a second rotary shaft, a second compression element comprising a cylinder and a rolling piston, and a second main bearing for supporting the second rotary shaft to one end of the second rotary shaft to be driven by the motor element to thereby form a second integral structure; and mounting a stator of the motor element into a center shell serving as the outer shell of a closed vessel containing therein the motor element and, after then, passing the first integral structure through the inside of the stator of the motor element, connecting the other end of the second rotary shaft of the second integral structure to the other portion of the rotor of the first integral structure in a close fit manner or in an adhesive manner, and mounting the first and second main bearings of the first and second integral structures to the center shell.

In an enclosed motor compressor of a two cylinder type according to the invention, there is formed a clearance, that is, clearance B between the eccentric portion of a first rotary shaft and a first main bearing, there is formed a clearance, that is, clearance C between the eccentric portion of a second rotary shaft and a second sub bearing in such a manner that the clearance C is larger than the clearance B, and there is further formed another clearance, that is, clearance D between the eccentric portion of the second rotary shaft and a second main bearing. Thanks to this structure, according to the invention, with respect to the axial movement of the rotary shaft, there is eliminated the possibility that the eccentric portion of the second rotary shaft may be in contact with the second main bearing and second sub bearing in the axial direction thereof.

Also, the finish surface of the main bearing on the side of the compression element, which is worked such that it can be touched by an assembling jig for assembling a pair of main bearings to an enclosed vessel, is provided in such a manner that it extends beyond the cylinder outside diameter of the compression element and, therefore, the pair of main bearings can be made parallel to each other with improved accuracy when they are assembled.

Further, due to the fact that one portion of a rotor of the motor element is connected to the first rotary shaft in a close fit manner and the other rotor is connected to the second rotary shaft in a close fit manner or in an adhesive manner, there is eliminated the possibility that there can be generated any backlash in the connecting key.

Moreover, the assembling jig is arranged such that it is able to touch the compression element side finish surface of the main bearing extending beyond the cylinder diameter of the compression element and both end faces of a center shell and can be mounted to the assembling jig mounting portion of the main bearing to thereby make the pair of main bearings be parallel to each other. The assembling jig is also arranged such that it is able to touch a cylinder having a finish surface on the inner or outer periphery thereof projecting out in the opposite direction of the sub bearing to the compression element to thereby axially align the pair of sub bearings with each other. This makes it easy to achieve the parallel arrangement of the pair of main bearings as well as the axial alignment of the pair of sub bearings with more accuracy.

In addition, according to the invention, there is provided an assembling method in which one portion of a rotor of the motor element is connected in a shrinkage fit manner to the first rotary shaft of an assembly, which is previously obtained by assembling the first rotary shaft, first compression element and first main bearing together, next the thus connected rotor is heated again and is then passed through a stator connected to the center shell in a shrinkage fit manner, and the other portion of the rotor is connected in a shrinkage fit manner to the second rotary shaft of another assembly, which is previously obtained by assembling the second rotary shaft, second compression element and second main bearing together. This makes it easy to achieve the assembling of an enclosed motor compressor of a two cylinder type with accuracy.

DETAILED DESCRIPTION OF THE PREFERRED EMBODIMENTS

Embodiment 1

Figure 1:
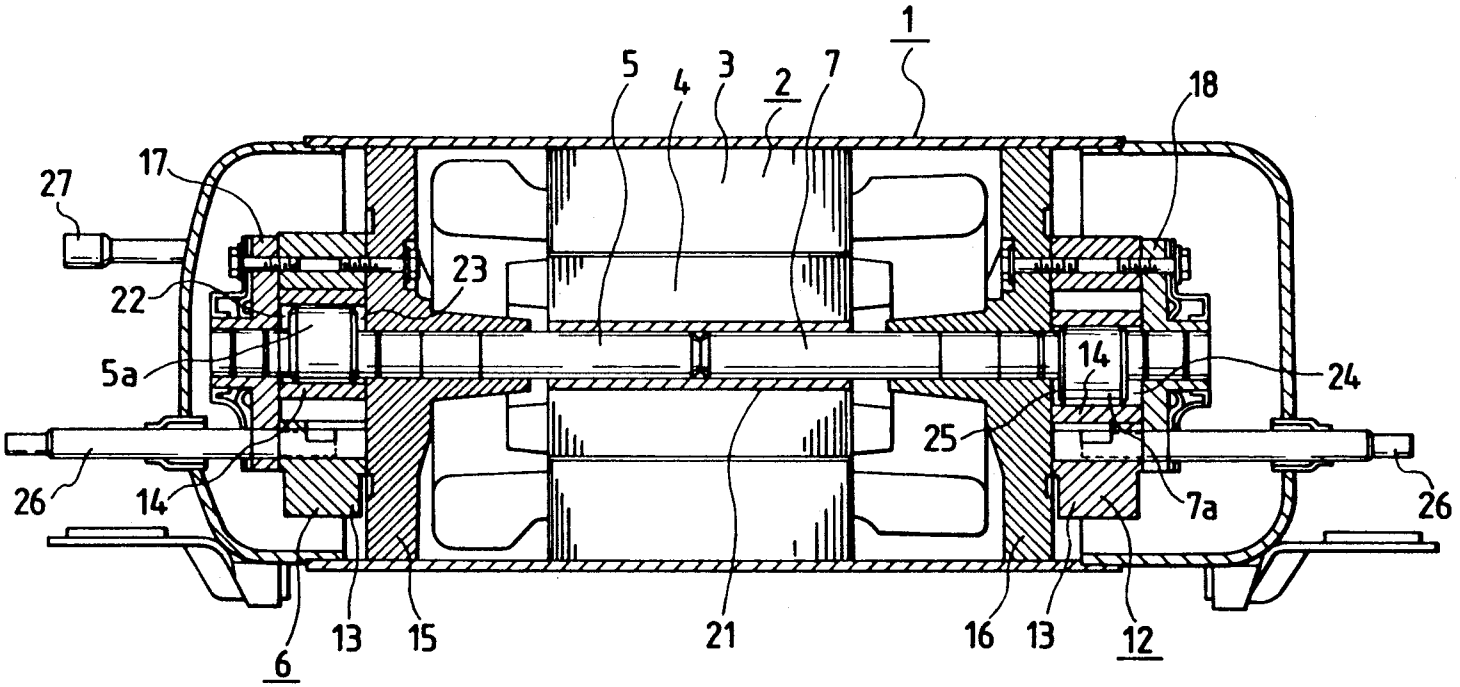
FIG. 1 is a section view of a first embodiment of an enclosed motor compressor of a two cylinder type according to the invention.

Now, description will be given below of a first embodiment 1 of an enclosed motor compressor of a two cylinder type according to the invention with reference to FIG. 1. In FIG. 1, the same reference characters as in FIG. 9 respectively designate the same or corresponding parts. In FIG. 1, 1 stands for a closed vessel, 2 designates a motor element, 3 expresses a stator of the motor element which is fixed in a shrinkage fit manner to the closed vessel 1 and 4 represents a rotor which cooperates with the stator 3 in forming the motor element 2. 5 designates a first rotary shaft which can be fixed through the rotor 4 and a sleeve 21, and 5*a* stands for an eccentric portion of the first rotary shaft 5. 6 designates a first compression element which is composed of a cylinder 13 and a rolling piston 14. 15 designates a first main bearing which is connected by welding to the closed vessel 1 and is used to support the first rotary shaft 5, and 17 stands for a first sub bearing which is also used to support the first rotary shaft 5. 22 designates a clearance A formed between the first sub bearing 17 and the eccentric portion 5*a* of the first rotary shaft 5, and 23 stands for a clearance B formed between the first main bearing 15 and the eccentric portion 5*a* of the first rotary shaft 5. 7 designates a second rotary shaft which is fixed to a sleeve 21 in a close fit manner or by means of an adhesive. 12 stands for a second compression element which is disposed opposed to the first compression element 6 with the motor element 2 between them and can be driven by the second rotary shaft 7 including an eccentric portion *7a*. The second compression element 12 is composed of a cylinder 13 and a rolling piston 14. 16 stands for a second main bearing which is connected by welding to the closed vessel 1 and is used to support the second rotary shaft 7, and 18 designates a second sub bearing which is also used to support the second rotary shaft 7. 24 stands for a clearance C formed between the second sub bearing 18 and the eccentric portion *7a* of the second rotary shaft 7, and 25 designates a clearance D formed between the second main bearing 16 and the eccentric portion *7a* of the second rotary shaft 7. 26 designates an inlet pipe which is in communication with the first and second compression elements, and 27 stands for a discharge pipe which is used to discharge compressed gas externally of the present compressor. Referring again to the above-mentioned clearance A 22, it is arranged such that, when the first rotary shaft 5 moves in the direction of the first compression element 6, then the first sub bearing 17 and the eccentric portion 5*a* of the first rotary shaft 5 can be brought into contact with each other, that is, the clearance A no longer exists ($A=0$). The clearances B 23, C 24 and D 25 are clearances which are generated when the clearance A 22 is caused to disappear ($A=0$). They are arranged such that $B<C$, $D>O$.

Next, description will be given below of the operation of the embodiment 1. When the motor element, that is, the stator 3 and rotor 4 are electrically energized, then the rotor 4 starts rotating to thereby drive or rotate the first rotary shaft 5 as well as the second rotary shaft 7. And the compression elements 6 and 12 respectively compress gas adsorbed by means of the inlet pipe 26 and the compressed gas is discharged through the discharge pipe 27 which is provided in the closed vessel 1. Here, the clearance B 23 to be formed between the first main bearing 15 and the eccentric portion 5*a* of the first rotary shaft 5, the clearance C 24 to be formed between the second sub bearing 16 and the eccentric portion 7*a* of the second rotary shaft 7, and the clearance D 25 to be formed between the second main bearing 16 and the eccentric portion 7*a* of the second rotary shaft 7 are clearances which are respectively generated when the first rotary shaft 5 moves in the direction of the first compression element 6 to thereby cause the clearance A 22 between the first sub bearing 16 and the eccentric portion 5*a* of the first rotary shaft 5 to be disappeared (that is, the clearance A 22 is caused to be O), and these clearances are arranged in such a relationship that C>B, D>O. For this reason, when the first rotary shaft 5 and second rotary shaft 7 move in the direction of the second compression element 12, the movement distances of the first and second rotary shafts 5 and 7 are respectively equal to or smaller than the clearance B, so that the first main bearing 15 and the eccentric portion 5*a* of the first rotary shaft 5 are brought into contact with each other but the eccentric portion 7*a* of the second rotary shaft 7 is not brought into contact with the second sub bearing 18 because the clearance C 24 is greater than the clearance B 23. Also, when the first and second rotary shafts 5 and 7 move in the direction of the first compression element 6, the first sub bearing 17 and the eccentric portion 5*a* of the first rotary shaft 5 are brought into contact with each other but the second main bearing 16 and the eccentric portion 7*a* of the second rotary shaft 7 are not brought into contact with each other because there exists the clearance D 25 between them. As a result of this, if the first and second rotary shafts are moved in the axial direction thereof, there can be generated noise which is caused by the contact of the eccentric portion 5*a* of the first rotary shaft 5 with the first main bearing 15 or first sub bearing 17, while there can be generated no noise due to the contact of the eccentric portion 7*a* of the second rotary shaft 7 with the second main bearing 16 or second sub bearing 18.

Embodiment 2

Figure 2:
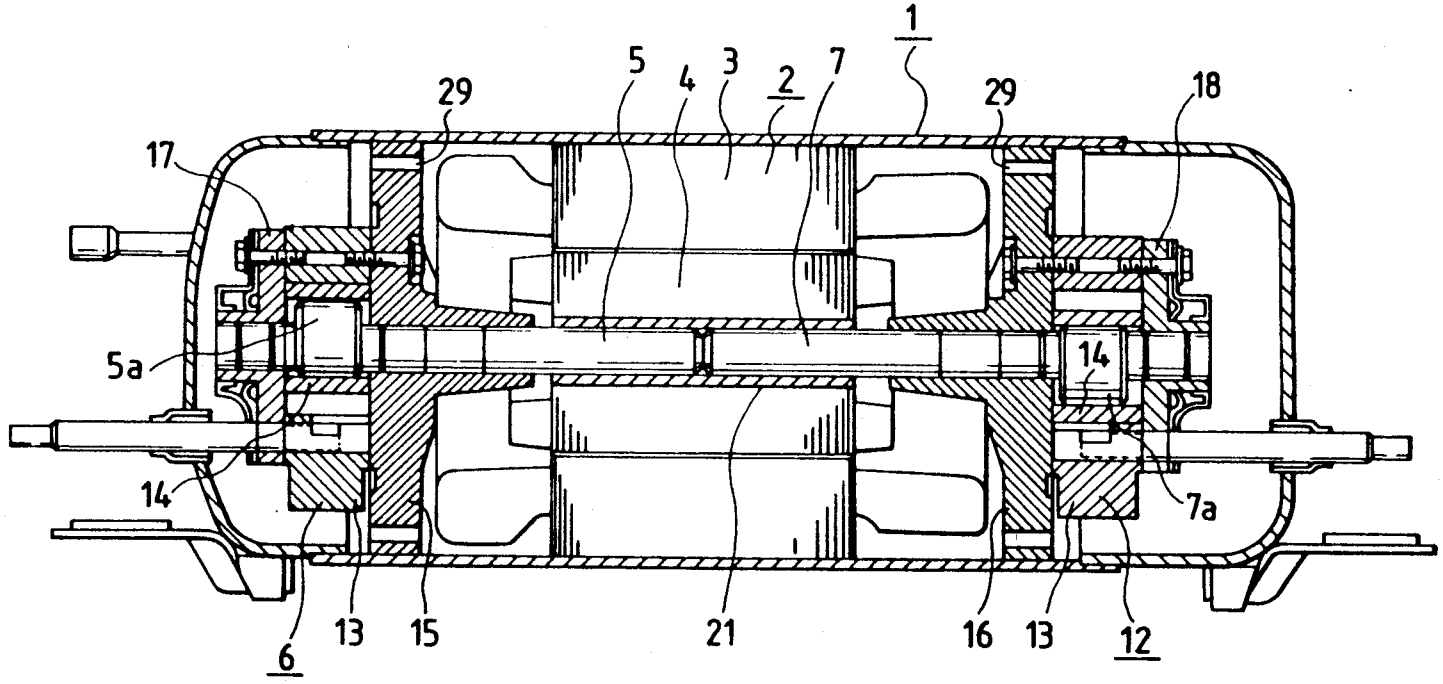
FIG. 2 is a section view of a second embodiment of an enclosed motor compressor of a two cylinder type according to the invention.

Next, description will be given below of another embodiment, that is, embodiment 2 of an enclosed motor compressor of a two cylinder type according to the invention with reference to FIGS. 2, 3 and 4. FIG. 2 is a section view of an enclosed motor compressor of a two cylinder type according to the invention, FIG. 3 is a perspective view of a cylinder included in each of first and second main bearings and first and second compression elements employed in the embodiment 2, and FIG. 4 is a section view of first and second sub bearings employed in the embodiment 2.

Figure 3:
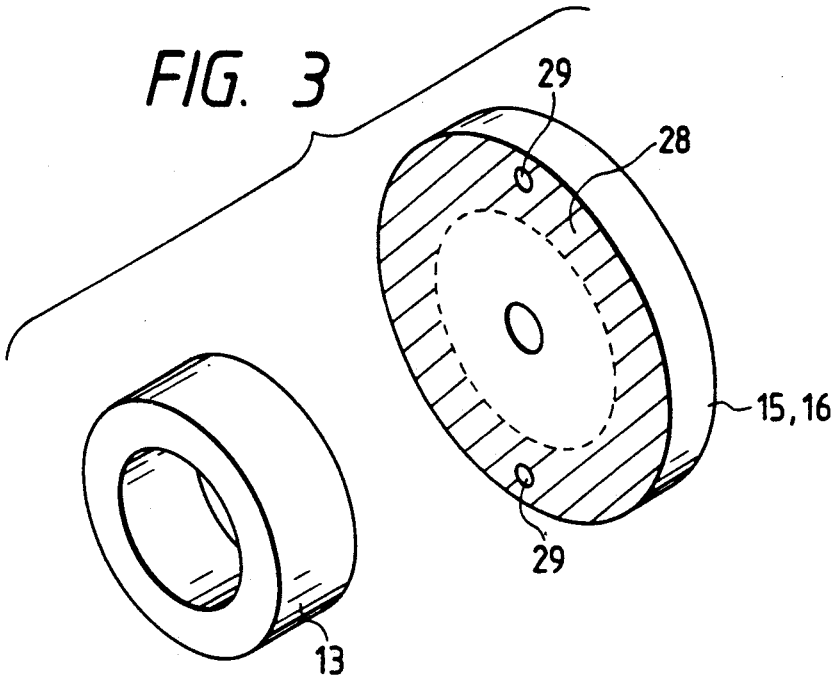
FIG. 3 is a perspective view of first and second main bearings as well as the cylinders of first and second compression elements employed in the second embodiment according to the invention.
Figure 4:
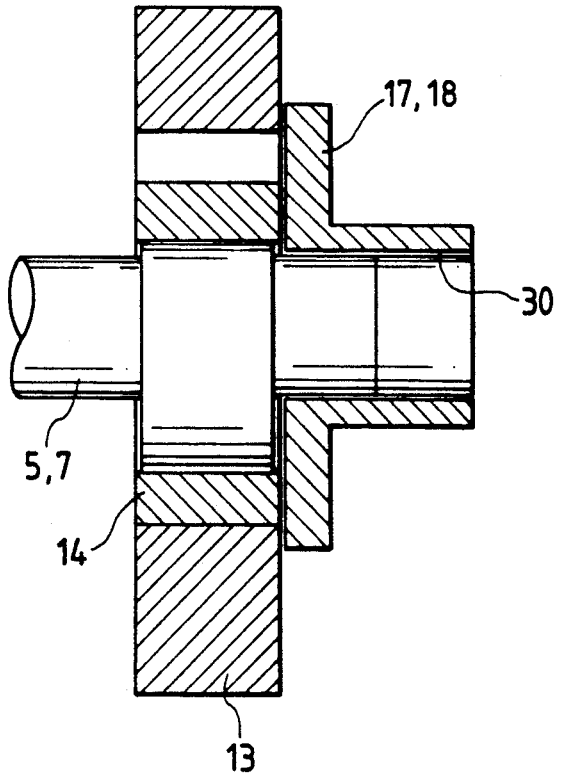
FIG. 4 is a section view of main portions of first and second sub bearings employed in the second embodiment.
Figure 9A:
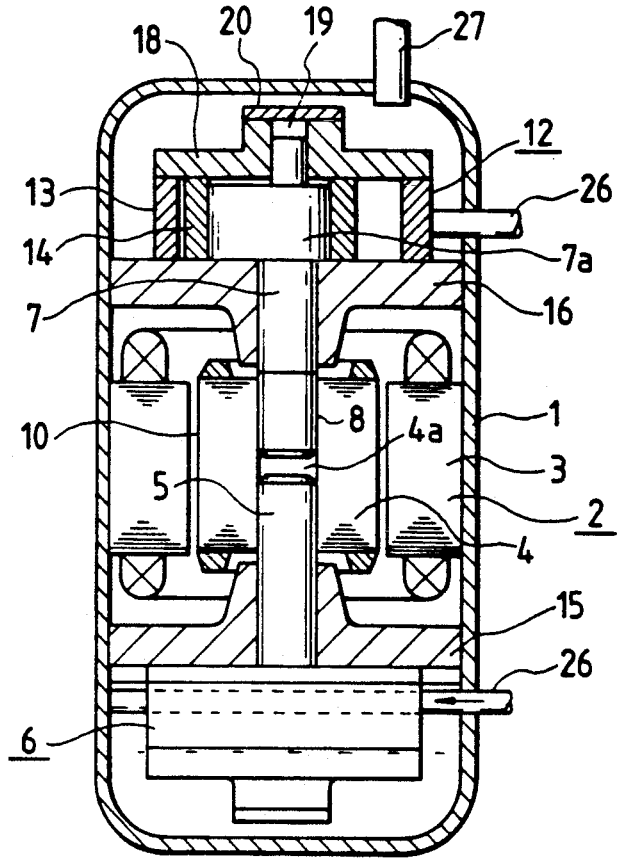
FIG. 9A is a section view of an enclosed motor compressor of a two cylinder type according to the prior art.
Figure 9B:
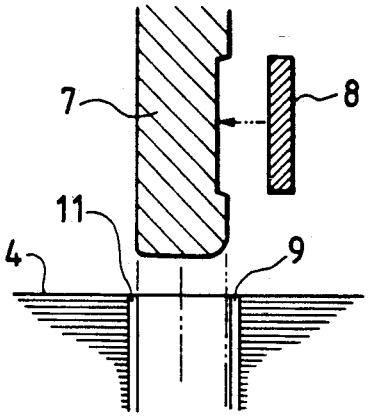
FIG. 9B is a section view of main portions for fastening of the enclosed motor compressor of a two cylinder type according to the prior art.

In FIGS. 2, 3 and 4, the same reference characters as in FIG. 9 designate the same or corresponding parts, respectively. In FIG. 2, 1 designates a closed vessel, 2 stands for a motor element, 3 represents a stator which forms a part of the motor element and is fixed to the closed vessel 1 in a shrinkage fit manner, and 4 points out a rotor which also forms a part of the motor element to construct the motor element in cooperation with the stator 3. 5 designates a first rotary shaft which is connected to one portion of the rotor 4 in a shrinkage fit manner by means of a sleeve 21, and 5*a* stands for an eccentric portion of the first rotary shaft 5. 6 designates a first compression element which is composed of a cylinder 13 and a rolling piston 14. 15 designates a first main bearing which is connected by welding to the closed vessel 1 and is used to support the first rotary shaft 5, while 17 stands for a first sub bearing which is also used to support the first rotary shaft 5. 12 designates a second compression element which is disposed in the opposite position to the first compression element 6 with the motor element 2 between them. The second compression element can be driven by a second rotary shaft 7 which is connected through the sleeve 21 to the other portion of the rotor in a shrinkage fit manner or in an adhesive manner. 7*a* stands for an eccentric portion of the second rotary shaft 7. The second compression element 12 is composed of a cylinder 13 and a rolling piston 14. 16 designates a second main bearing which is used to support the second rotary shaft 7 and is connected by welding to the closed vessel 1, while 18 stands for a second sub bearing which is also used to support the second rotary shaft 7. Now, in FIG. 3, 28 designates a finish surface which is provided in each of the first and second main bearings 15 and 16 so as to extend beyond the outside diameter of the cylinder 13 and with which an assembling jig for assembling the first and second main bearings 15 and 16 to the closed vessel 1 can be brought into contact. And 29 stands for a threaded hole which is used to mount the assembling jig 28.

Also, in FIG. 4, 17 designates a first sub bearing, 18 a second sub bearing, 5 a first rotary shaft, 7 a second rotary shaft, 13 a cylinder, 14 a rolling piston, and 30 an aligning inner peripheral surface which is provided so as to project out in the opposite direction to the cylinder 13 disposed on the slide surface of each of the first and second sub bearings 17 and 18. Alternatively, the aligning surface can also be provided on the outer periphery of the slide portion of each of the first and second sub bearings.

Next, description will be given below of a method of assembling the embodiment 2 of the invention. Accuracy in assembling the first rotary shaft 5 and first compression element 6 as well as in assembling the second rotary shaft 7 and second compression element 12 is to be determined when the first and second main bearings 15 and 16 respectively supporting the first and second rotary shafts 5 and 7 by means of the rotor 4 are fixed by welding or a similar connecting means to the closed vessel 1 to which the stator 3 of the motor element 2 is fixed. For this determination, there is necessary a positioning portion which can be used to position the second main bearing 16 with respect to the first main bearing 15 such that they are parallel with each other and are in axial alignment with each other. In this embodiment, the first and second main bearings 15 and 16 respectively have finish surfaces which are formed by grinding or by polishing and with which the assembling jig for assembling the first and second main bearings 15 and 16 to the closed vessel 1 can be brought into contact, and the finish surfaces are provided in such a manner that they respectively extend beyond the outside diameters of the cylinders 13 of the first and second main bearings 15 and 16. Thanks to this, according to the embodiment 2, the first and second main bearings 15 and 16 can be assembled with improved parallel accuracy when compared with a case using the surfaces of the first and second main bearings 15 and 16 which are in touch with the cylinders 13 and extend within the outside diameters of the cylinders 13.

Also, according to the embodiment 2, one portion of the rotor 3 is connected to the first rotary shaft 5 in a shrinkage fit manner and the other portion of the rotor 3 is connected to the second rotary shaft 7 in a close fit manner or in an adhesive manner. This eliminates the possibilities that noise can be generated due to a backlash in the connecting portion key 8 and that noise can be generated due to the repeated contact and separation of the inner periphery of the rotor 3 with respect to the first and second rotary shafts 5 and 7. Also, owing to this structure, no foreign matter can be produced due to the backlash in the connecting portion key 8 and due to the repeated contact and separation of the inner periphery of the rotor 3 with respect to the first and second rotary shafts 5 and 7.

Further, according to the embodiment 2, due to the fact that the first and second sub bearings 17 and 18 respectively have finish surfaces in front of the slide surfaces thereof which are formed by grinding or by polishing and are used to align axially the first and second sub bearings with each other, the first and second sub bearings can be assembled with improved accuracy by use of the finish surfaces.

Embodiment 3

Figure 5:
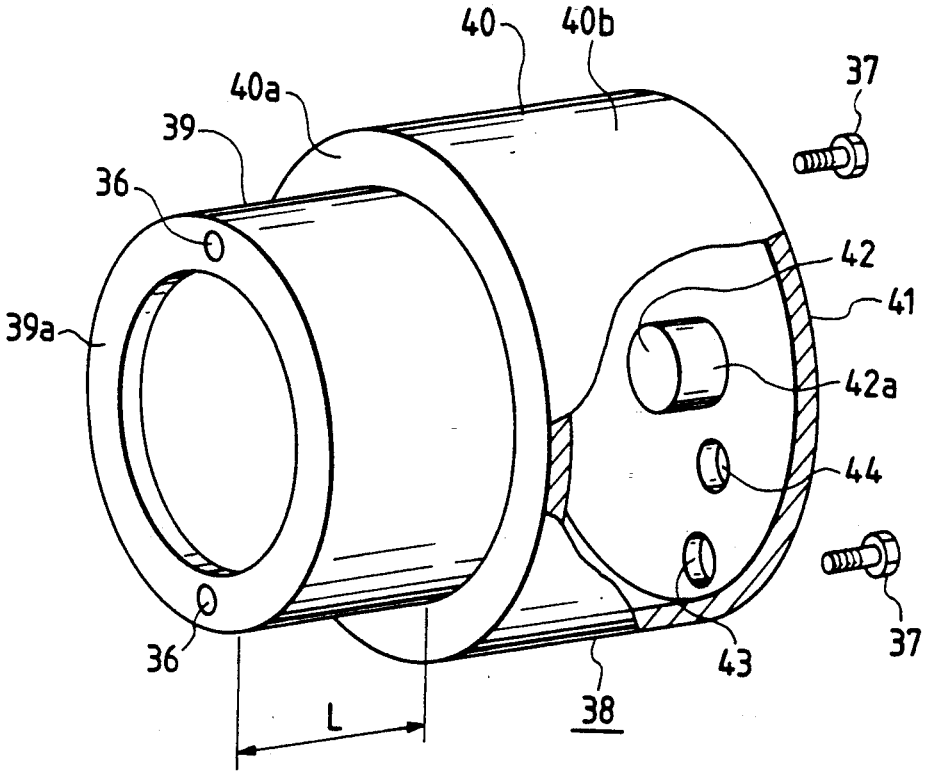
FIG. 5 is a perspective view of an assembling jig employed in a third embodiment according to the invention.
Figure 6:
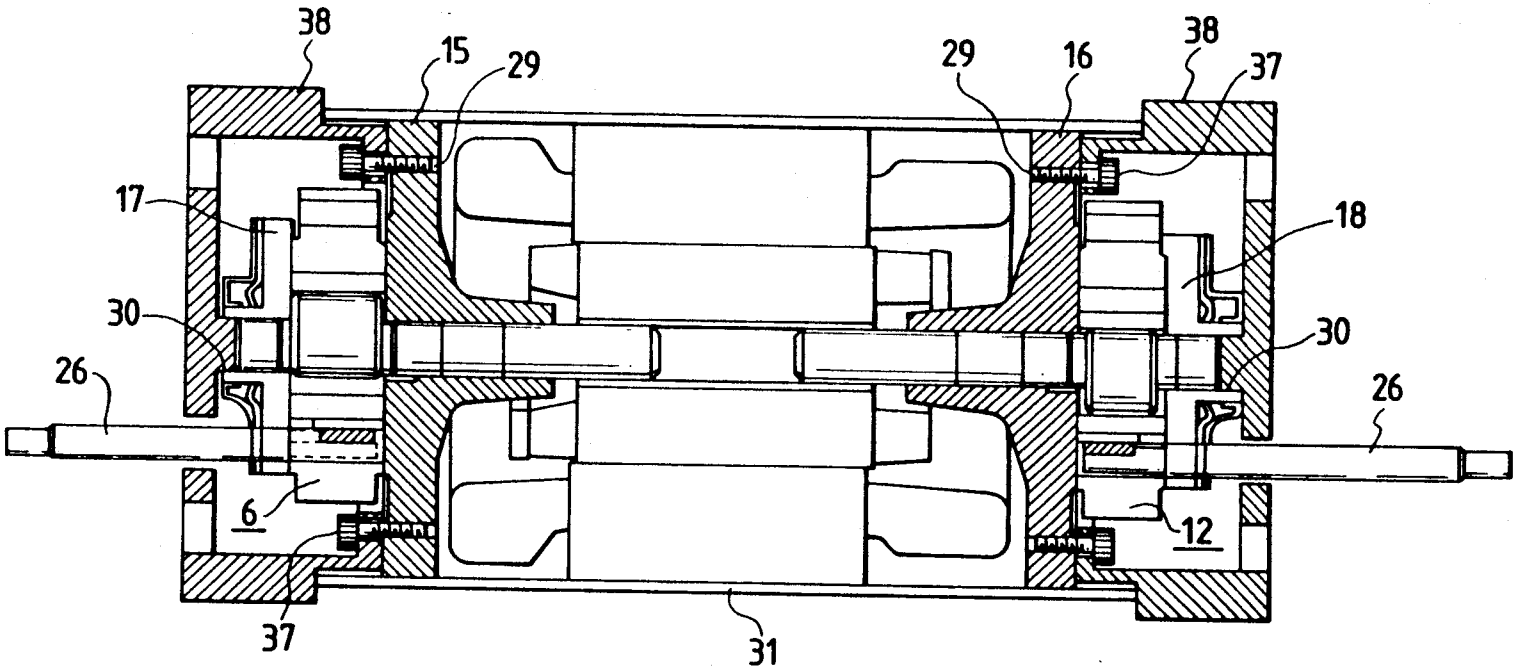
FIG. 6 is a section view of a position for mounting the assembling jig employed in the third embodiment.

Now, description will be given below of the further embodiment, that is, embodiment 3 of an enclosed motor compressor of the two cylinder type according to the invention with reference to FIGS. 5 and 6. FIG. 5 is a perspective view of an assembling jig employed in the embodiment 3, and FIG. 6 is a section view of an enclosed motor compressor of a two cylinder type according to the embodiment 3, showing a position to mount an assembling jib which is used to parallel, align and position the main bearings of the enclosed motor compressor of a two cylinder type. In these figures, reference character 31 designates a center shell the two ends of which are made parallel; 6, a first compression element; 12, a second compression element; 15, a first main bearing; 16, a second main bearing; 29, a threaded hole; 38, an assembling jig; 39, a first cylinder; **39*a*, a first cylinder end face which is to be brought into contact with the first and second main bearings 15 and 16; 40, a second cylinder; 40*a*, a second cylinder end face which is to be brought into contact with both surfaces of the center shell 31; and 40*b*, a second cylinder outer peripheral surface. The first cylinder end face 39*a* is parallel to the second cylinder end face 40*a* and a distance L between the first cylinder end face 39*a* and the second cylinder end face 40*a* is equal to the distance between the first and second main bearings 15 and 16 and the two end faces of the center shell 31. 41 designates a side plate which is provided on the second cylinder 40 on the opposite side of the first cylinder 39. 42 stands for a boss which is disposed in the side plate 41 and also includes a boss outer peripheral surface 42 coaxial with the second cylinder outer peripheral surface 40*b*. 43 designates a bolt mounting tool hole for tool which is used to mount an assembling jig 38 by use of a bolt 37. 44 designates an escape hole for an inlet pipe 26. 37 stands for a bolt which is used to pass the assembling jig 38 through a bolt hole 36 and mount the assembling jig 38 into the threaded holes 39 of the first and second main bearings 15 and 16**.

Next, description will be given below of a method of assembling the motor compressor according to the embodiment 3. The performance of the first and second compression elements 6 and 12 depends on the accuracy with which the first and second main bearings are made parallel and aligned when they are fixed to the center shell 31 by welding or by other similar connecting means. In the present embodiment 3, the boss outer peripheral surface of the boss 42 of the assembling jig 38 is brought into contact with an aligning finish surface 30 which is provided on and projected from the bearing slide surface of the first sub bearing 17, the first cylinder end face **39*a* is brought into contact with the first main bearing 15, the bolt 37 is mounted into the threaded hole 29 of the first main bearing 15 through the bolt hole 36 of the assembling jig 38, and the second cylinder end face 30*a* of the assembling jig 38 is brought into contact with on end of the center shell 31. Similarly, the boss outer peripheral surface of the boss 42 of the assembling jib 38 is brought into contact with an aligning finish surface 30 which is provided on and projected from the bearing slide surface of the second sub bearing 18, the first cylinder end face 39*a* of the assembling jib is 38 is brought into contact with the second main bearing 16, the bolt 37 is mounted into the threaded hole 39 of the second main bearing 16 through the bolt hole 36 of the assembling jig 32, and the second cylinder end face 40*a* of the assembling jig 38 is brought into contact with the outer end of the center shell 31. Next, the second cylinder outer peripheral surfaces of a pair of assembling jigs 38 respectively mounted to the two sides of the center shell 31 are axially aligned with each other. The first cylinder end face 39*a* of the assembling jig 38 is parallel to the second cylinder end face 40*a* thereof, which makes the first main bearing 15 parallel to one end of the center shell 31. The distance L between the first cylinder end face 39*a* and second cylinder end face 40*a* of the assembling jib 38 is equal to the distance between the first main bearing 15 and one end of the center shell 31, so that the position of the first main bearing 15 can be decided. Similarly, the second main bearing 16 is made parallel to the other end of the center shell 31, so that the position of the second main bearing 16 can be decided. Also, because the two ends of the center shell 31 are parallel to each other, the first and second main bearings 15 and 16 are made parallel to each other. Further, since the second cylinder outer peripheral surface 40*b* of the assembling jig 38 is coaxial with the boss outer peripheral surface 42*a*, the first and second sub bearings 17 and 18 are made coaxial with each other. As the first sub bearing 17 is previously made coaxial with the first main bearing 15 as well as the second sub bearing 18 is previously made coaxial with the second main bearing 16, the first and second bearings 15 and 16** are made coaxial with each other.

Embodiment 4

Figure 7:
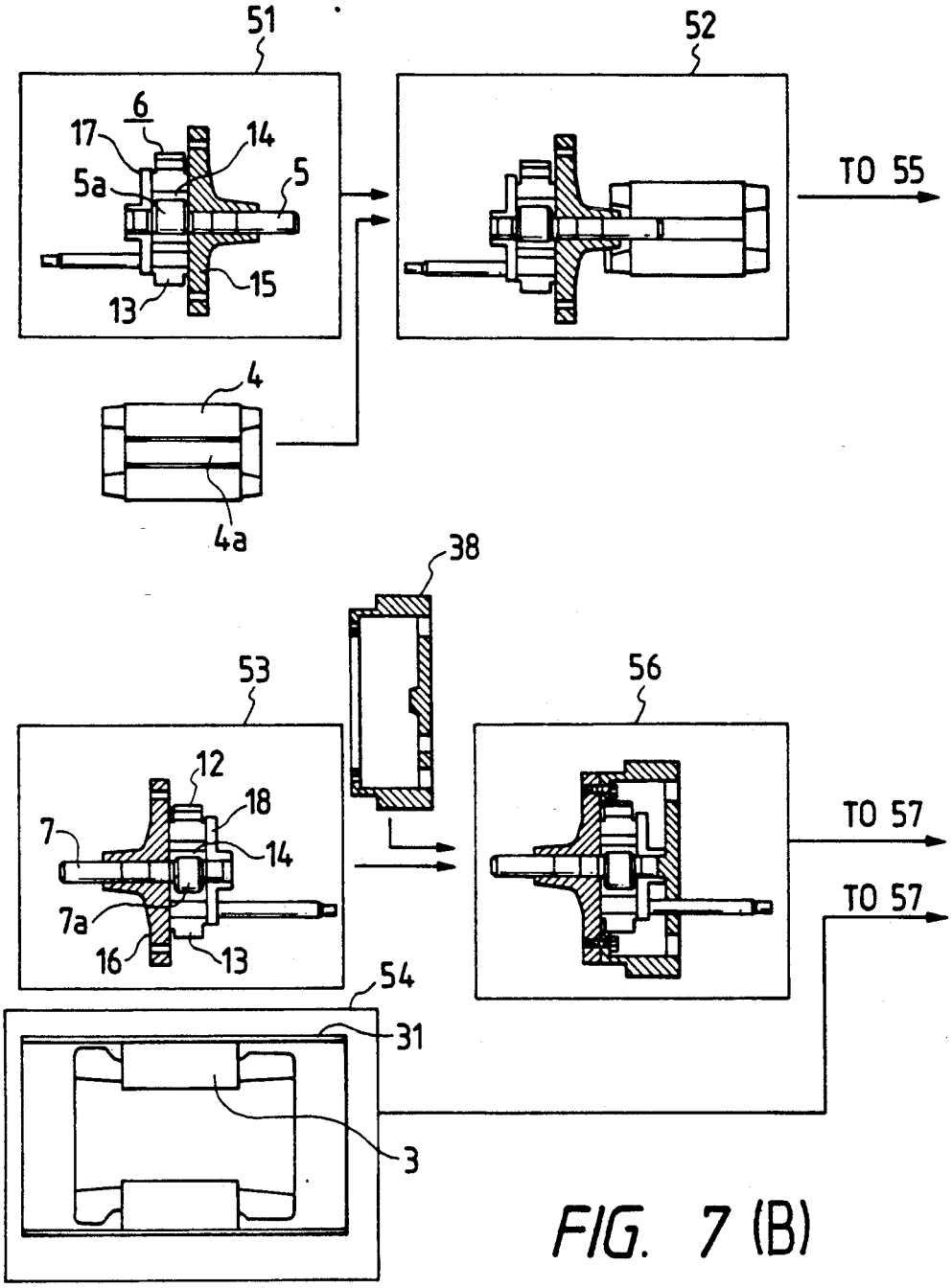
FIGS. 7A and 7B are assembling flow charts (½) to be applied to a fourth embodiment according to the invention.
Figures 8A, 8B:
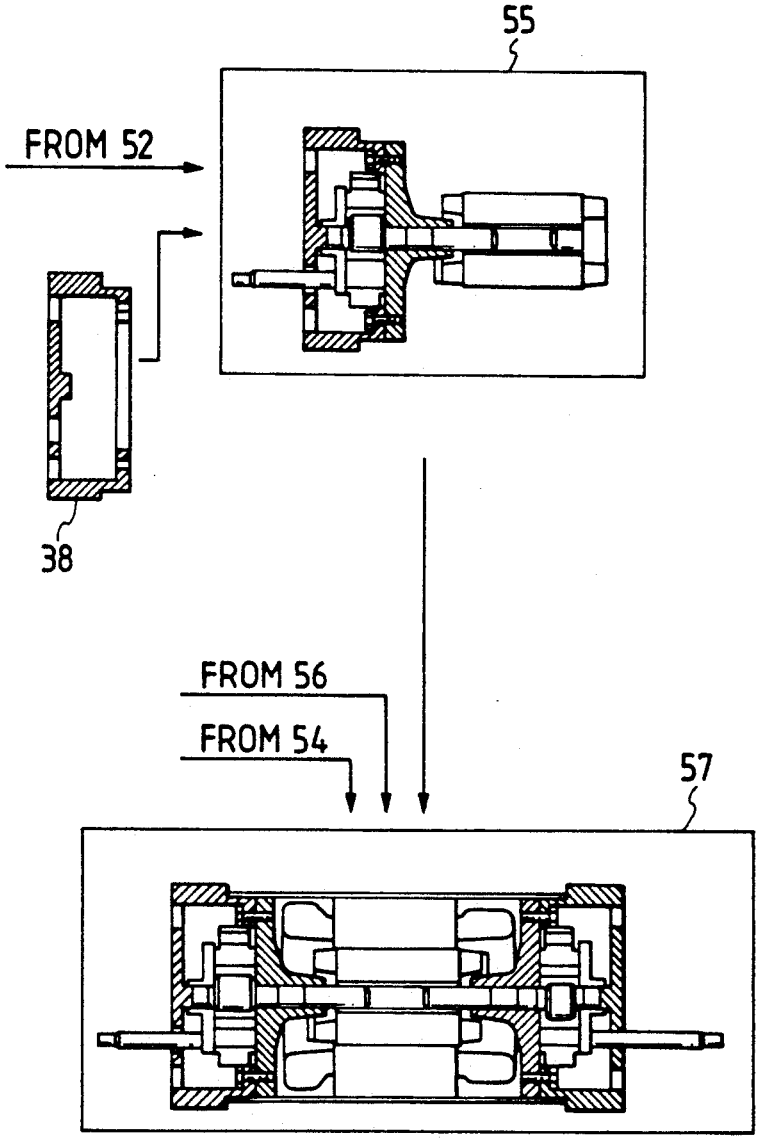
FIGS. 8A and 8B are assembling flow charts (2/2) to be applied to the fourth embodiment according to the invention.

Now, description will be given below of a fourth embodiment 4 of an enclosed motor compressor of a two cylinder type according to the invention with reference to FIGS. 7 and 8. Like reference characters respectively designate the same or equivalent parts as in FIGS. 1 and 5. FIGS. 7 and 8 are respectively assembling flow charts which show a method of assembling the compressor according to the invention. In Step 51, a first sub bearing 17, a first compression element 6 which is composed of a cylinder 13 and a rolling piston 14, and a first main bearing 15 are assembled onto a first rotary shaft 5, more particularly, onto the eccentric portion 5*a* thereof. In Step 52, one portion of a rotor 4 is connected in a shrinkage fit manner to the opposite side of the first rotary shaft 5 to the first compression element 6 assembled in Step 51, thereby forming a first integral structure. In Step 53, a second sub bearing 18, a second compression element 12 composed of a cylinder 13 and a rolling piston 14, and the second main bearing 16 are assembled onto a second rotary shaft 7, more particularly, onto the eccentric portion 7*a* thereof, thereby forming a second integral structure. In Step 54, a stator 3 is connected to a center shell 31 in a shrinkage fit manner. In Step 55, the first cylinder end face 39*a* of an assembling jig 38 is mounted to an assembling jig mounting portion which is provided in the first main bearing 15 of the first integral structure assembled in Step 52. In Step 56, the first cylinder end face 39*a* of the assembling jig 38 is mounted to an assembling jig mounting portion which is provided in the second main bearing 16 of the second integral structure assembled in Step 53. In Step 57, the second integral structure assembled in Step 56 is inserted into the center shell 31 assembled in Step 54, and the second cylinder end face 40*a* of the assembling jig 38 is brought into contact with one end face of the center shell 31. Next, the other portion of the rotor 4 assembled in Step 55 is heated again and is inserted into the stator 3 assembled in Step 53, and at the same time the second rotary shaft 7 of the second integral structure assembled in Step 56 is inserted into a shaft hole 4*a* formed in the rotor 4 and the rotor 4 is connected in a shrinkage fit manner to the second rotary shaft 7 at a position where the second cylinder end face 40*a* of the assembling jig 38 assembled in Step 55 is brought into contact with the other end of the center shell 31. After then, the first and second main bearings 15 and 16 are connected by welding to the center shell 31 to thereby complete the assembling within the center shell 31. Here, it should be noted that, although in Step 57 the rotor 4 is connected to the second rotary shaft 7 in a shrinkage fit manner, alternatively, the rotor 4 may be connected to the second rotary shaft 7 in an adhesive manner.

Next, description will be given below of a method of assembling the embodiment 4. In general, it is not easy to connect the first rotary shaft 5 for driving the first compression element 6 and the second rotary shaft 7 for driving the second compression element 12 respectively to either side of the rotor 4 of the motor element 2 interposed between the first and second compression elements 6 and 12 through the inside of the stator 3 shrinkage fitted to the center shell 31 at a time and with high accuracy. On the contrary, the present method comprises several steps of assembling the embodiment: that is, in step 52 one end of the rotor 4 is connected in a shrinkage fit manner to the first rotary shaft 5, second main bearing 16, first compression element 6 and first main bearing 15 assembled in Step 51 to thereby form the first integral structure; in Step 54, the second rotary shaft 7, second sub bearing 18, second compression element 12 and second main bearing 16 are assembled together to thereby form the second integral structure; and, next, the other end of the rotor 4 of the first integral structure is heated again, is then passed through the inside of the stator 3 connected in a shrinkage fit manner to the center shell 31 in Step 53, and is finally connected in a shrinkage fit manner to the second rotary shaft 7 of the second integral structure. In other words, according to the present method, the compressor can be assembled with high accuracy and with ease by employing the above-mentioned several steps as well as by use of the assembling jig 38.

According to the invention, a clearance between the eccentric portion of the second rotary shaft and the second sub bearing is set greater than a clearance between the eccentric portion of the first rotary shaft and the first main bearing, and also there is formed a clearance between the eccentric portion of the second rotary shaft and the second main bearing, so that, even when the second rotary shaft moves in the axial direction thereof, there is eliminated the possibility that the eccentric portion of the second rotary shaft can be in touch with the second main bearing and second sub bearing in the axial direction, thereby being able to reduce noise.

Also, a pair of main bearings for supporting the rotary shafts respectively include, on the side of a pair of compression elements, finish surfaces which respectively extend perpendicularly to the slide surfaces of the main bearings, are set so as to extend beyond the outside diameter of the cylinders of the compression elements, and are worked such that an assembling jig for assembling the main bearings to the closed vessel can be brought into contact with the finish o surfaces. The pair of main bearings further include, on the side of the compression elements, assembling jig mounting portions to which the assembling jig can be mounted. Due to this, when assembling the main bearings, the accuracy with which the main bearings are made parallel to each other can be improved, and thus the performance and reliability of the compressor can be improved, thereby being able to reduce noise.

Further, according to the invention, there are provided a first rotary shaft for driving a first compression element which is connected to one portion of a rotor of a motor element in a close fit manner, and a second rotary shaft for driving a second compression element which is connected to the other portion of the rotor of the motor element in a close fit manner or in an adhesive manner. This can prevent noise due to the backlash of a connecting portion key as well as noise caused by the repeated contact and separation of the inner periphery of the rotor with respect to the rotary shafts.

Moreover, there is provided an assembling jig which can be brought into contact with the compression element side finish surfaces of a pair of main bearings for supporting the rotary shafts and the end face of a center shell serving as an outer shell of a closed vessel containing therein a motor element to thereby make the main bearings parallel to each other, and also which can be brought into contact with the cylinders of a pair of sub bearings for supporting the rotary shafts, each of the cylinders having on the inner periphery or outer periphery a finish surface projecting out on the opposite direction thereof to the motor element to thereby align the sub bearings with each other axially. Thanks to this, the paralleling and aligning accuracy can be improved and, thus the performance and reliability of the compressor can be improved, thereby being able to reduce noise.

In addition, according to the invention, there is provided a method of assembling the motor compressor in which one portion of a rotor of a motor element is connected in a close fit manner to the previously assembled first rotary shaft, first compression element and first rotary shaft of a first main bearing and the thus formed structure is then passed through the inside of a stator connected to the center shell, and the other portion of the rotor is connected in a close fit manner or in an adhesive manner to the previously assembled second rotary shaft, second compression element and second rotary shaft of a second main bearing. The employment of the present assembling method makes it possible to assemble the compressor with high accuracy as well as with ease, thereby being able to reduce noise.

What is claimed is:

1. An enclosed motor compressor of a two cylinder type, comprising:

first and second rotary shafts respectively having first and second eccentric portions for driving first and second compression means respectively disposed on both ends of a motor means;

first and second sub bearings respectively disposed on the opposite sides of said compression means to said motor means for supporting said rotary shafts; and first and second main bearings respectively interposed between said motor means and said compression means for supporting said rotary shafts;

wherein a first clearance is formed between a surface of said first sub bearing forming one of said sub bearings and a first end face of the first eccentric portion of said first rotary shaft forming one of said rotary shafts, said surface of said first sub bearing being perpendicular to a first slide surface thereof and facing said first compression means forming one of said compression means and provided on said first sub bearing, said first end face of the first eccentric portion being opposed to said first sub bearing surface, said first clearance being arranged such that, when said first rotary shaft moved in the direction of said first compression means, said first sub bearing surface and said first end face of the first eccentric portion of said first rotary shaft can be brought into contact with each other;

a second clearance is formed between a surface of said first main bearing and a second end face of the first eccentric portion of said first rotary shaft, said surface of said first main bearing being perpendicular to the first slide surface thereof and facing said first compression means, said second end face of the first eccentric portion being opposed to said first main bearing surface, said second clearance being generated when said first sub bearing surface and said second end face of the first eccentric portion of said first rotary shaft are caused to get in contact with each other;

a third clearance is formed between a surface of said second sub bearing forming the other of said sub bearings and a first end face of the second eccentric portion of said second rotary shaft forming the other of said rotary shafts, said surface of said second sub bearing being perpendicular to a second slide surface thereof and facing said second compression means forming the other of said compression means and provided on said second sub bearing, said first end face of the second eccentric portion being opposed to said second sub bearing surface, said third clearance being generated when said first sub bearing surface and said second eccentric portion's first end face of said first rotary shaft are caused to get in contact with each other, said third clearance being set greater than said second clearance; and a fourth clearance is formed between a surface of said second main bearing perpendicular to the second slide surface thereof and facing said second compression means provided on said second main bearing and a second end face of the second eccentric portion of said second rotary shaft opposed to said second main bearing surface, said fourth clearance being generated when said first sub bearing surface and said first end face of the first eccentric portion of said first rotary shaft are caused to get in contact with each other.

2. An enclosed motor compressor of a two cylinder type comprising:

a closed vessel;

a motor means disposed within said closed vessel;

first and second compression means respectively including a cylinder disposed at both ends of said motor means and a rolling piston disposed within said cylinder;

first and second main bearings respectively interposed between said first and second compression means and said motor means, said first and second compression means supporting two rotary shafts respectively for mounting said compression means thereto and being driven by said motor means;

compression means side finish surfaces of said main bearings perpendicular to a slide surface of said main bearings, extending beyond the outside diameter of said cylinder, and worked so as to be touchable by an assembling jig for assembling said main bearings in parallel to said closed vessel; and assembling jig mounting portions respectively provided on the compression sides of said main bearings extending in the same direction of said compression means side finish surfaces for mounting said assembling jig.

3. An enclosed motor compressor of a two cylinder type as set forth in claim 2, wherein said first and second compression means are respectively disposed on both sides of said motor means, a first rotary shaft for driving said first compression means connected to one portion of a rotor of said motor means in a close fit manner, and a second rotary shaft for driving said second compression means connected to the other portion of the rotor of said motor means in a close fit manner or in an adhesive manner.

4. An enclosed motor compressor of a two cylinder type as set forth in claim 2, wherein said assembling jig includes:

a first cylinder having an opening at one end thereof;

a second cylinder disposed coaxially with said first cylinder at the other end of said first cylinder and having an outside diameter larger than that of said first cylinder, a side plate of said second cylinder disposed in the opposite side to said first cylinder, a first cylinder end face of said first cylinder disposed on the opening side thereof so as to be touchable with said compression means side finish surfaces of said first and second main bearings, a second cylinder end face disposed in parallel to said first cylinder end face on the side of said first cylinder so as to be touchable with an end face of a center shell serving as the outer shell of said closed vessel containing therein said motor means, said second cylinder end face being used to make said main bearings be parallel to each other, a boss projecting out from said side plate into said second cylinder, said boss being disposed on the opposite side of said compression means to said motor means so as to be touchable with a cylinder having a finish surface on the inner or outer periphery thereof projecting on the opposite side of said motor means into a pair of sub bearings supporting said rotary shafts, said boss being coaxial with the outer periphery of said second cylinder to thereby be able to align said pair of sub bearings axially with each other, said assembling jig being mounted on said assembly jig mounting portions.

* * * * *